US009272394B2

(12) United States Patent
Buchanan

(10) Patent No.: US 9,272,394 B2
(45) **Date of Patent: *Mar. 1, 2016**

(54) PLIERS APPARATUS

(71) Applicant: Nigel Buchanan, New Gilston (GB)

(72) Inventor: Nigel Buchanan, New Gilston (GB)

( * ) Notice: Subject to any disclaimer, the term of this patent is extended or adjusted under 35 U.S.C. 154(b) by 154 days.

This patent is subject to a terminal disclaimer.

(21) Appl. No.: 13/998,134

(22) Filed: Oct. 4, 2013

(65) Prior Publication Data

US 2015/0013507 A1 Jan. 15, 2015

Related U.S. Application Data

(63) Continuation-in-part of application No. 13/987,064, filed on Jul. 2, 2013.

(51) Int. Cl.

| | |
|---|---|
| ***B25B 7/14*** | (2006.01) |
| ***B25B 13/46*** | (2006.01) |
| ***B25B 7/10*** | (2006.01) |
| ***B25B 7/12*** | (2006.01) |

(52) U.S. Cl.

CPC ... *B25B 7/14* (2013.01); *B25B 7/10* (2013.01); *B25B 7/12* (2013.01); *B25B 13/46* (2013.01)

(58) Field of Classification Search

CPC ..... B25B 7/10; B25B 7/12; B25B 7/14; B25B 7/16

See application file for complete search history.

(56) References Cited

U.S. PATENT DOCUMENTS

| | | | | | |
|---|---|---|---|---|---|
| 1,106,518 | A * | 8/1914 | Matti | 81/319 |
| 1,508,510 | A * | 9/1924 | Edwards | 81/356 |
| 1,534,218 | A * | 4/1925 | Jones | 81/320 |
| 2,595,368 | A * | 5/1952 | Plautz | 81/365 |
| 3,142,212 | A * | 7/1964 | Grape | 81/383.5 |
| 3,657,947 | A * | 4/1972 | Myers | 81/134 |
| 3,657,949 | A * | 4/1972 | Myers | 81/370 |
| 4,274,312 | A * | 6/1981 | Finn | 81/356 |
| 4,893,530 | A * | 1/1990 | Warheit | 81/409.5 |
| 5,408,904 | A * | 4/1995 | Neff | 81/360 |
| 5,660,089 | A * | 8/1997 | Chow | 81/413 |
| 5,964,130 | A * | 10/1999 | Wang | 81/424 |
| 5,970,827 | A * | 10/1999 | Lin | 81/409 |
| 6,026,716 | A * | 2/2000 | Orlosky | 81/360 |
| 6,065,376 | A * | 5/2000 | Khachatoorian | 81/407 |
| 6,116,124 | A * | 9/2000 | Ping | 81/385 |
| D431,435 | S * | 10/2000 | McCalla et al. | D8/52 |
| 6,155,142 | A * | 12/2000 | Bally et al. | 81/389 |
| 6,508,149 | B1 * | 1/2003 | Heggemann et al. | 81/320 |
| 6,640,441 | B1 * | 11/2003 | Huang | 30/233 |
| 7,313,989 | B1 * | 1/2008 | Tortolani, Jr. | 81/355 |
| 8,434,391 | B2 * | 5/2013 | Buchanan | 81/409.5 |
| 8,561,506 | B2 * | 10/2013 | Buchanan et al. | 81/407 |
| 8,677,865 | B2 * | 3/2014 | Buchanan et al. | 81/407 |
| 9,010,222 | B2 * | 4/2015 | Peirce | 81/319 |
| 2009/0056510 | A1 * | 3/2009 | Buchanan et al. | 81/355 |
| 2009/0178518 | A1 * | 7/2009 | Buchanan et al. | 81/324 |
| 2010/0282033 | A1 * | 11/2010 | Buchanan | 81/409.5 |
| 2011/0232429 | A1 * | 9/2011 | Buchanan et al. | 81/409 |
| 2012/0297938 | A1 * | 11/2012 | Lai | 81/356 |

* cited by examiner

*Primary Examiner* — David B Thomas

(74) *Attorney, Agent, or Firm* — Dan DeLaRosa

(57) ABSTRACT

A pliers apparatus is provided, the apparatus comprises two arms, two jaws, struts and a switch allowing the apparatus to function as a ratcheting device, pliers and clamps.

22 Claims, 13 Drawing Sheets

PLIERS APPARATUS

RELATED APPLICATION

This application is a continuation-in-part of U.S. application Ser. No. 13/987,064 filed on Jul. 2, 2013 entitled "Pliers Apparatus".

BACKGROUND OF THE INVENTION

1. Field of the Invention

The present invention relates to a pliers apparatus and more specifically, a pliers apparatus that functions as an all-in-one pliers, ratchet and clamping device.

2. Summary of the Invention

In one embodiment, the present invention relates to a pliers apparatus comprising a first arm having opposing ends, a first end of the first arm forming a first handle, a second end of the first arm comprising a jaw element, the first arm further comprises an arc situated between the handle and the first jaw element, the first arm comprising a channel; a second arm having opposing ends, a first end of the second arm forming a second handle; a second jaw element pivotally attached to a portion of a second arm, the second arm comprises at least one switch and at least one pawl; and at least one strut having opposing ends, a first end is pivotally attached to a portion of the second arm, and the switch is designed to be activated to thereby engage the pawl with the strut so that it functions as a ratcheting device and locks the first and second jaws, and the switch is designed to be deactivated to thereby allow the pawl to disengage with the strut so that the apparatus functions as pliers.

In another embodiment, the second end of the strut comprises a cam, and the cam is designed to be fit within the channel of the first arm of the apparatus. In a further embodiment, the apparatus comprises an insert and the insert may be a cam, roller or any equivalent. In other further embodiments, the insert may be placed into the strut, the handle, the jaws or combinations thereof In still another embodiment, the first jaw element has a first contact surface. In yet another embodiment, at least a portion of the first contact surface comprises a plurality of teeth.

In still yet another embodiment, the arc forms a radius from about 40 degrees to about 140 degrees. In other embodiments, the arc may be on the strut, either handle (stationary or movable) or on both. In a further embodiment, the first jaw element is generally perpendicular to said first arm. In still a further embodiment, the arc has a width from about 5% to about 80% thinner than the rest of the second end of the first arm.

In yet a further embodiment, the second jaw element has a second contact surface. In still yet a further embodiment, at least a portion of the second contact surface comprises a plurality of teeth. In another further embodiment, the first and second jaw elements are moved by squeezing the first and second handles.

In another embodiment, the switch has at least one spring. In yet another embodiment, the second arm has at least one spring. In still another embodiment, the jaw element is a fixed jaw. In another further embodiment, the roller comprises at least one protrusion. In still yet a further embodiment, the roller travels within the channel when the jaw elements contact one another. In another embodiment, the strut has a plurality of teeth that interact with the pawl.

In still yet another embodiment, the apparatus further comprises at least one shoe designed to assist in having the jaw members close parallel to another to provide a tight grip. In a further embodiment, the cam functions as a pawl catch. In another further embodiment, the cam is a roller. In still yet a further embodiment, the apparatus further comprises at least two sleeves designed to cover the handles. In another embodiment, the cam comprises a cavity for receiving a cam spring.

In still yet another embodiment, the present invention provides for a pliers apparatus comprising a first arm having opposing ends, a first end of the first arm forming a first handle, a second end of the first arm comprising a jaw element, the first arm comprising a channel; a second arm having opposing ends, a first end of the second arm forming a second handle; a second jaw element pivotally attached to a portion of a second arm, the second arm comprising at least one switch and at least one pawl; and at least one strut having opposing ends, a first end of the strut is pivotally attached to a portion of the second arm, a second end of the strut has a cam, the cam is designed to be fit within the channel of the first arm, the switch is designed to be activated to thereby engage the pawl with the strut so that it functions as a ratcheting device and locks the first and second jaws, the switch is designed to be deactivated to thereby allow the pawl to disengage with the strut so that the apparatus functions as pliers.

In a further embodiment, the present invention relates to a pliers apparatus comprising a first arm having opposing ends, a first end of the first arm forming a first handle, a second end of the first arm comprising a jaw element, the first arm further comprising an arc situated between the handle and the first jaw element, the first arm comprising a channel; a second arm having opposing ends, a first end of the second arm forming a second handle; a second jaw element pivot ally attached to a portion of a second arm, the second arm comprising at least one switch and at least one pawl; and at least one strut having opposing ends, a first end being pivotally attached to a portion of the second arm, a second end of the strut has a cam, the cam is designed to be fit within the channel of the first arm, the switch is designed to be activated to thereby engage the pawl with the strut so that it functions as a ratcheting device and locks the first and second jaws, the switch is designed to be deactivated to thereby allow the pawl to disengage with the strut so that the apparatus functions as pliers, wherein the first and second jaw elements are moved and contact one another by squeezing the first and second handles.

In another embodiment, the present invention relates to a pliers apparatus comprising: a first arm having opposing ends, a first end of the first arm forming a first handle, a second end of the first arm comprising a jaw element, and the first arm comprises a channel; a second arm having opposing ends, a first end of the second arm forming a second handle; a second jaw element pivotally attached to a portion of a second arm, and the second arm comprising at least one switch and at least one pawl; and at least one strut having opposing ends, a first end is pivotally attached to a portion of the second arm, a second end of the strut comprises a cam, and the cam is designed to be fit within the channel of the first arm of said apparatus, the strut further comprising an arc situated between the first and the second end of the strut, the switch is designed to be activated to thereby engage the pawl with the strut so that it functions as a ratcheting device and locks the first and second jaws, and the switch is designed to be deactivated to thereby allow said pawl to disengage with the strut so that the apparatus functions as pliers.

In a further embodiment, the present invention relates to a pliers apparatus comprising: a first arm having opposing ends, a first end of the first arm forming a first handle, a second end of the first arm comprising a jaw element, the first arm comprising a channel; a second arm having opposing ends, a first end of the second arm forming a second handle; a second jaw element having a first end and a second end, the first end of the second jaw element having a contact surface, the second end of the second jaw element is pivotally attached to a portion of the second arm, the second jaw element further comprising an arc situated between said first and second end of the second jaw element, and the second arm comprising at least one switch and at least one pawl; and at least one strut having opposing ends, a first end of the strut is pivotally attached to a portion of said second arm, a second end of the strut has a cam, the cam is designed to be fit within the channel of the first arm, the switch is designed to be activated to thereby engage the pawl with the strut so that it functions as a ratcheting device and locks the first and second jaws, the switch is designed to be deactivated to thereby allow the pawl to disengage with the strut so that the apparatus functions as pliers.

In another further embodiment, the present invention provides for a pliers apparatus comprising: a first arm having opposing ends, a first end of the first arm forming a first handle, a second end of the first arm comprising a jaw element, the first arm comprising a channel; a second arm having opposing ends, a first end of the second arm forming a second handle; a second jaw element having a first end and a second end, the first end of the second jaw element has a contact surface, the second end of the second jaw element is pivotally attached to a portion of the second arm, the second jaw element further comprises an arc situated between the first and second end of the second jaw element, the second arm comprises at least one switch and at least one pawl; and at least one strut having opposing ends, a first end is pivotally attached to a portion of the second arm, a second end of the strut has a cam, and the cam is designed to be fit within the channel of the first arm, the strut further comprises an arc situated between the first and the second end of the strut, and the switch is designed to be activated to thereby engage the pawl with the strut so that it functions as a ratcheting device and locks the first and second jaws, the switch is designed to be deactivated to thereby allow the pawl to disengage with the strut so that the apparatus functions as pliers, wherein the first and second jaw elements are moved and contact one another by squeezing the first and second handles.

BRIEF DESCRIPTION OF THE DRAWINGS

The accompanying drawings are included to provide a further understanding of the present invention. These drawings are incorporated in and constitute a part of this specification, illustrate one or more embodiments of the present invention, and together with the description, serve to explain the principles of the present invention.

Among those benefits and improvements that have been disclosed, other objects and advantages of this invention will become apparent from the following description taken in conjunction with the accompanying drawings. The drawings constitute a part of this specification and include exemplary embodiments of the present invention and illustrate various objects and features thereof.

DETAILED DESCRIPTION OF THE INVENTION

As required, detailed embodiments of the present invention are disclosed herein; however, it is to be understood that the disclosed embodiments are merely exemplary of the invention that may be embodied in various forms. The figures are not necessarily to scale, some features may be exaggerated to show details of particular components. Therefore, specific structural and functional details disclosed herein are not to be interpreted as limiting, but merely as a basis for the claims and as a representative basis for teaching one skilled in the art to variously employ the present invention.

Figure 1:
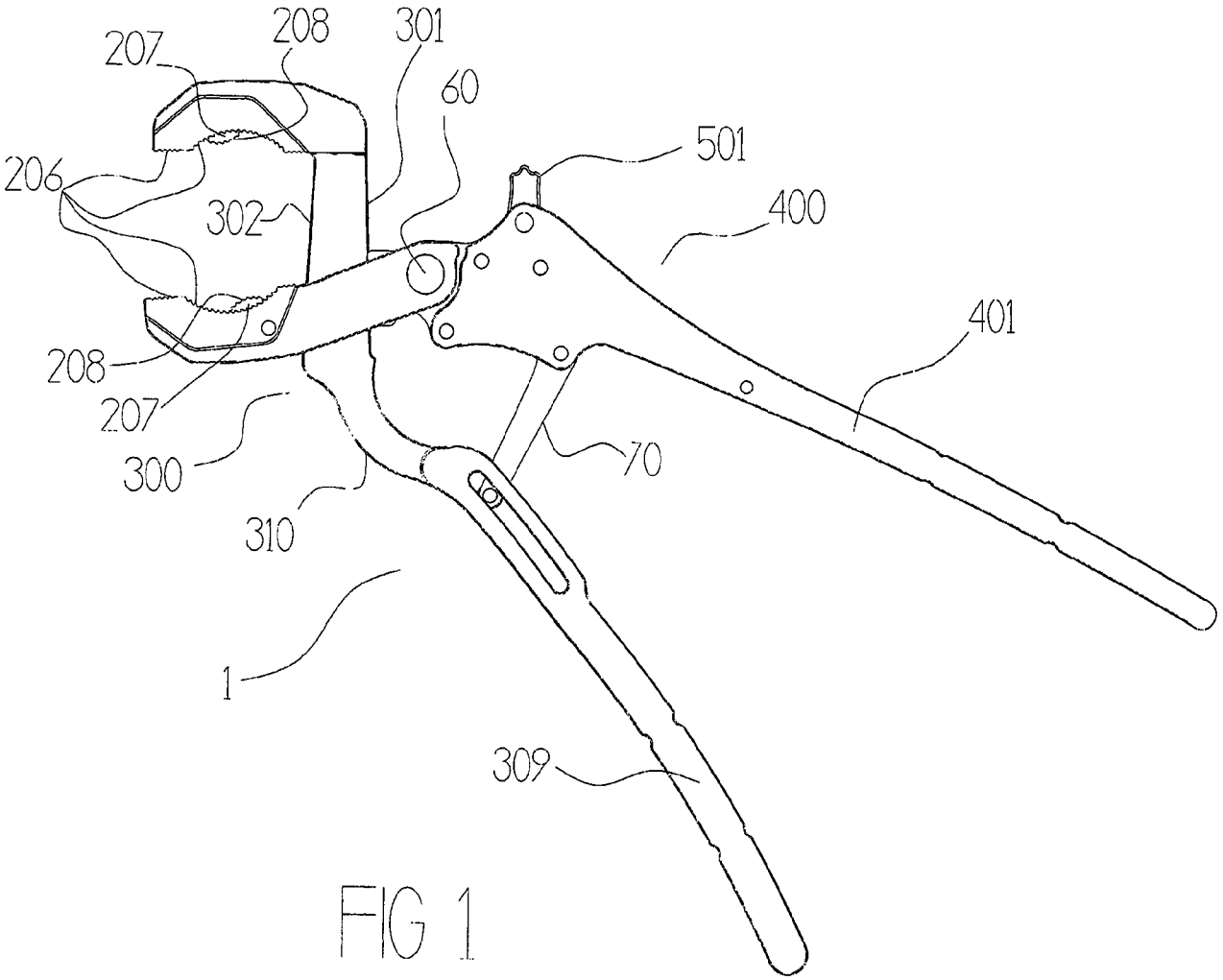
FIG. 1 is a side perspective view of pliers of the present invention in a closed position.
Figure 2:
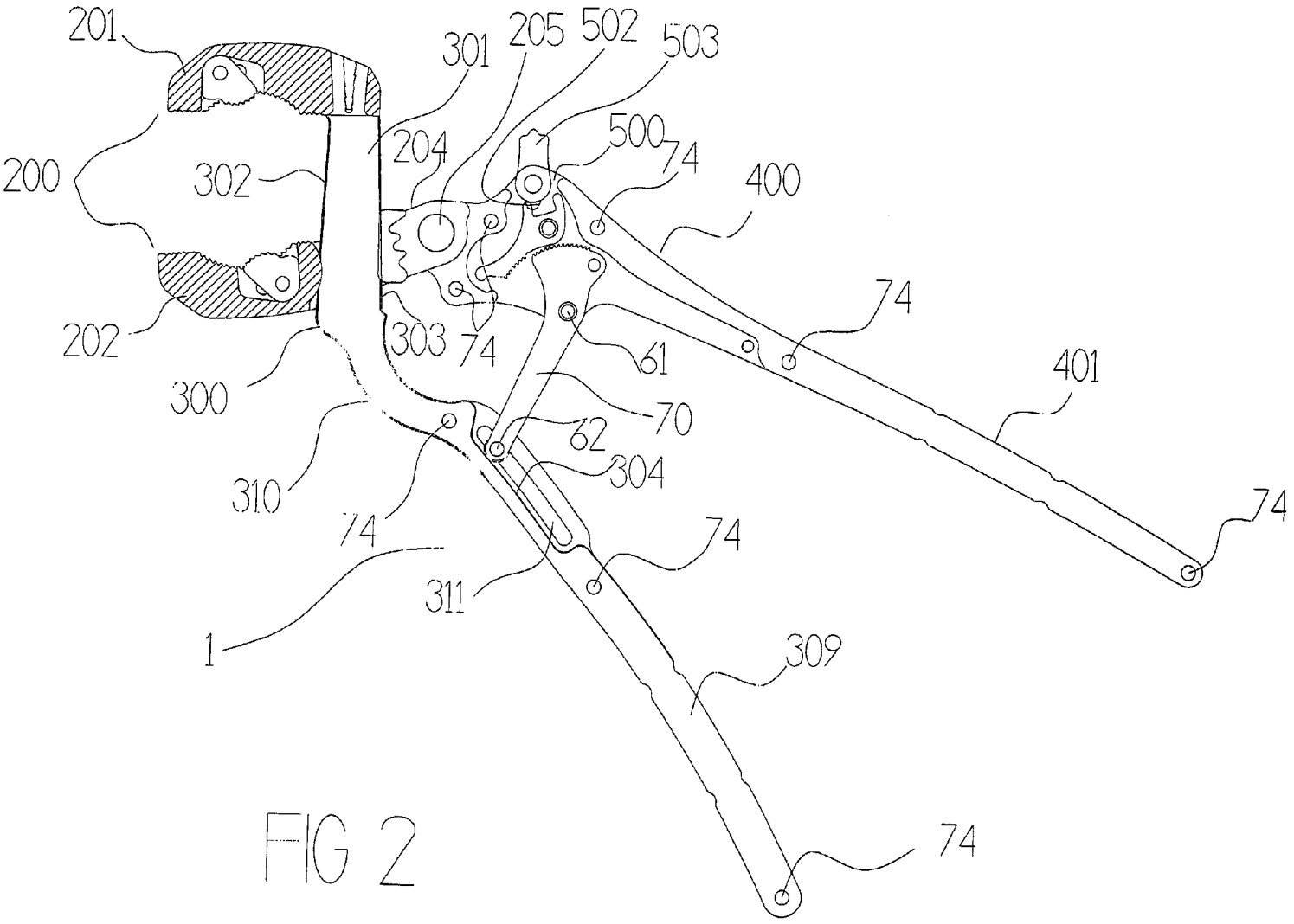
FIG. 2 is a cutaway view of the pliers of FIG. 1.
Figure 3:
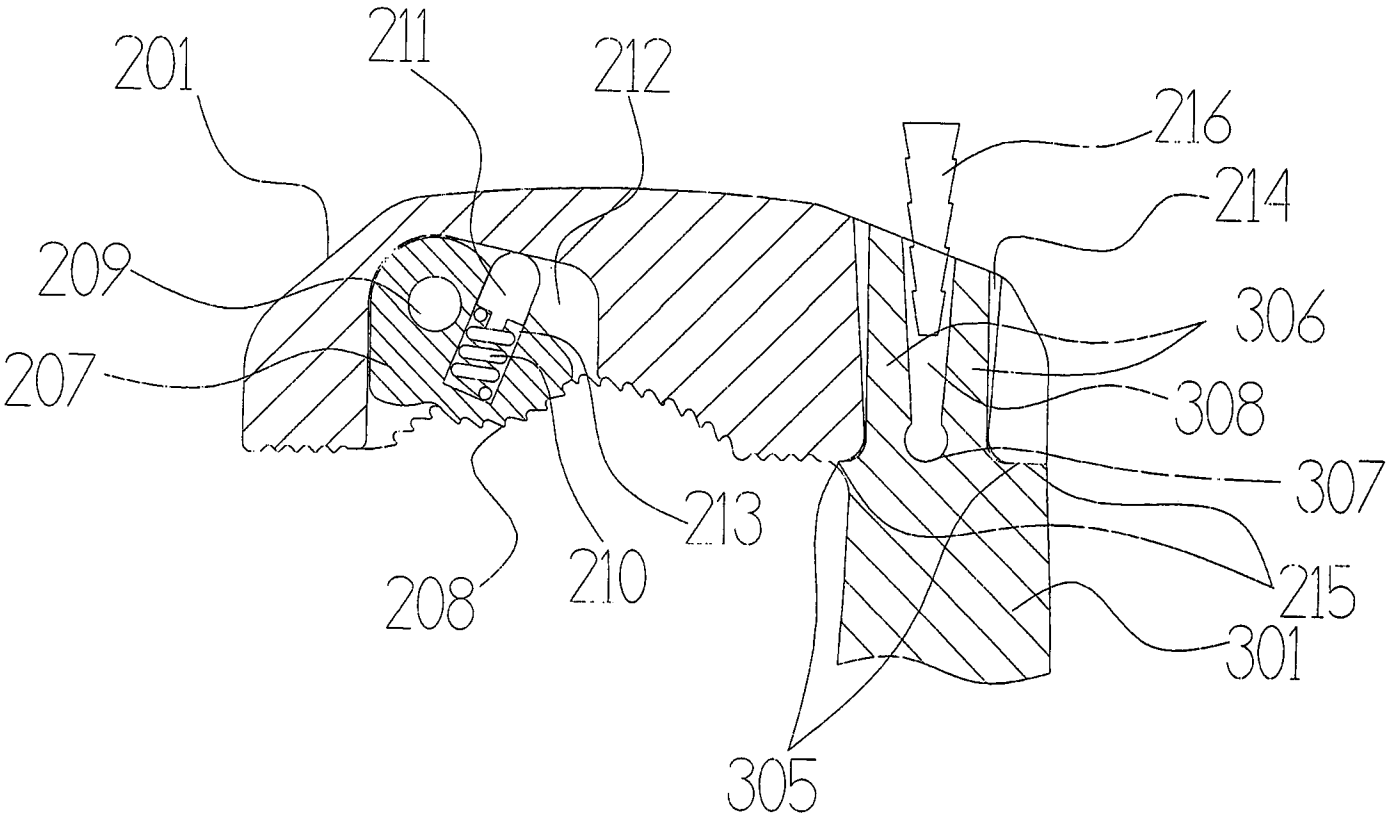
FIG. 3 is a cutaway view of the fixed jaw of the pliers.

FIG. 1 illustrates an embodiment of a set of sprung grip pliers 1, the pliers 1 are at rest.

Figure 4:
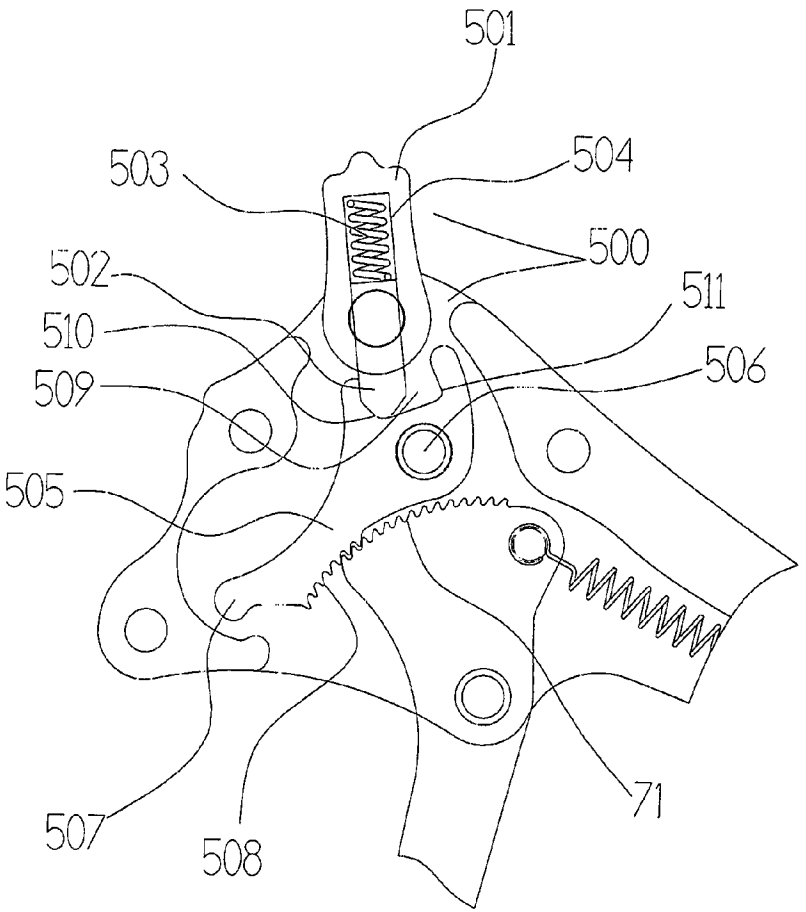
FIG. 4 is a cutaway view of the internals of the pliers.

FIG.4 shows a side view of the first jaw or fixed jaw 201 with a section removed in order to illustrate one of the fixing methods of the jaw 201 upon the clamp bar portion 301 of the first handle or fixed handle 400. Although many differing types of attachment could be utilized, the example shown is one method with normal Metal Injection Moulding (MIM) is used. The attachment portion 306 of the clamp bar 301 takes the profile of a split prong 306 which is fitted within the fixed jaw abutment aperture 214 whereby the fixed jaw abutment faces 215 about the fixed handle abutment faces 305. The aperture 214 diverges slightly from abutment faces 215, 305 such that when an appropriately angled barbed wedge 216 is competently driven into the tapered gap 308 of the split prong 306 the split prong 306 usefully deforms into a robust wedge shape substantially gripping and affixing the fixed jaw 200 upon the fixed handle 400. The base 307 of the split prong tapered gap 308 has a circular profiled 307 in order to prevent stress fatigue during use.

The resiliently sprung ratchet cam 207 is further illustrated within its cavity 212. The cam is resiliently biased into the outward position shown by a compression spring 210, acting within a bore 213 against an optional push rod 211. The cam 207 can usefully rotate around its pivot 209 against the tension of the spring 210, whereas the cam 207 can be easily urged into its corresponding recess 212 when required to do so. The tolerance between the pivot pin 209 and its bore 217 is chosen such as to ensure that when force is applied during use to the cam gripping profile 208 the force is substantially transmitted by the abutment of the cam radius 218 against the corresponding recess radius 219, thereby preventing undue forces upon the pivot shaft 209.

Figure 5:
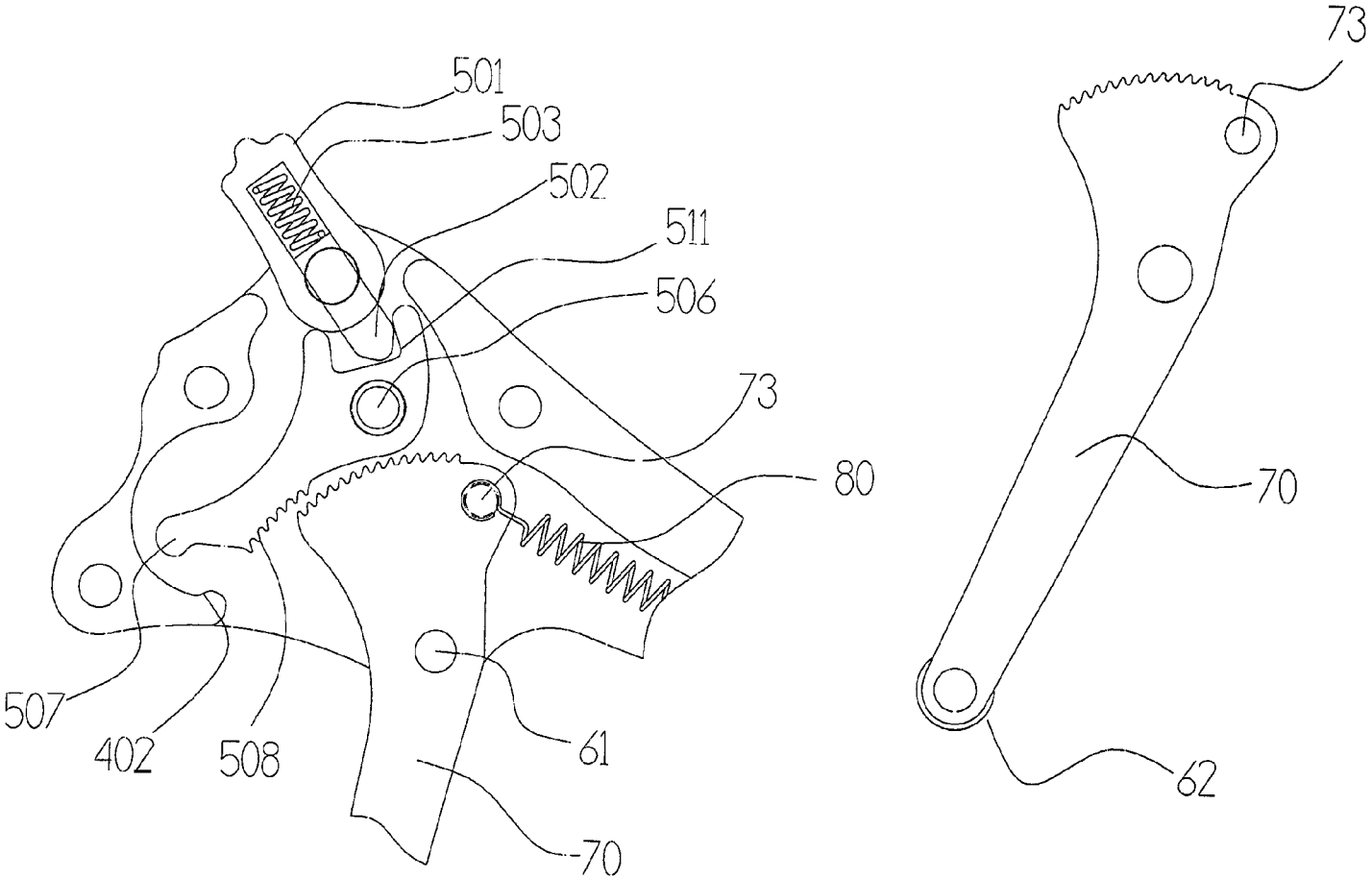
FIG. 5 is a cutaway view of the internals and the strut of the pliers.

FIGS. 4 and 5 illustrates the lock/unlock or changeover portion 500 whereas the mechanism can be set to allow the first or fixed 300 and the second or moving 400 handles to either move freely relative to one another when utilised or be conveniently locked in their last operated position.

The actuator 501 is manually positioned to the required operative location, FIG. 4 illustrates the switch 501 in the locking position L whereas the push rod 502 urged by the actuator spring 503 acts upon the swivel lock 505 actuation recess locking portion 510 in order to resiliently rotate the lock 505 around its swivel axle 506 such that the lock teeth 508 are resiliently positioned such as to usefully robustly engage with the corresponding pivotal link 70 toothed portion 71 as required. As the handles 307, 401 are closed relative to one another, the gripping force applied between the first jaw 201 and second jaw 202 is progressively increased usefully allowing the operator to conveniently apply the correct gripping force for the particular job encountered.

As shown in FIG. 5 when the switch 501 is rotated into the unlock U position the push rod 502 resiliently acts upon the actuating recess unlocking portion 511 resiliently rotating the pawl or locking pawl 505 into the unlocked or open position U whereas its teeth 508 are completely disengaged from the pivotal strut teeth 71. As the teeth 71, 508 are saw like in profile the gripping portions 309, 401 need to be squeezed to finally release the locking mechanism 500 usefully providing a further safety lock.

Figure 6:
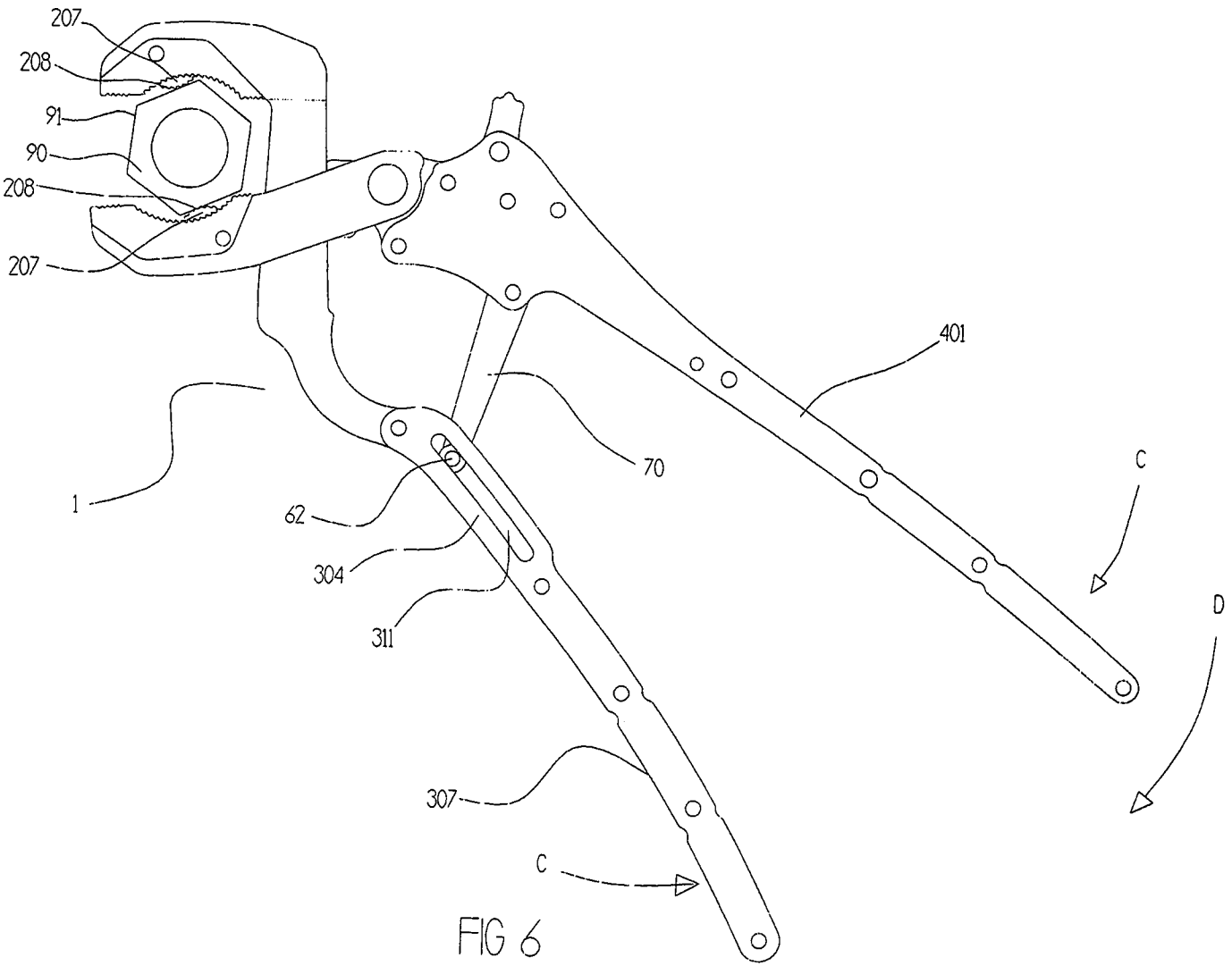
FIG. 6 is a side perspective view of the pliers engaging a bolt.

FIG. 6 illustrates a partially activated set of clamp pliers 1 the handles 300, 400 having been closed or alternately locked part way until the jaws 201, 202 gripping profiles 309, 401 abut the periphery of the fastener 90, 92 to be operated. When the handles are operated in the drive D direction the resilient ratchet cams 207 act on the operated fastener 90, within its physical limitations and dependant on the size/profile of the fastener or workpiece 90, 92 the cam 207 protrudes out its recess 212 resiliently propelled by their cam springs 210 until they are abutting the surface of the workpiece 90, 92. As further shown in FIG. 6 when the pliers 1 are rotated in the drive D direction the cams 207 tighten T upon the workpiece 90, 92 as the elliptical gripping profiles 208 of the cams lessen the gap between pair of cams 207 as they rotate around their pivots 209 thus usefully improving the cam's 207 grip upon the fastener 90, 92 worked.

Figure 7:
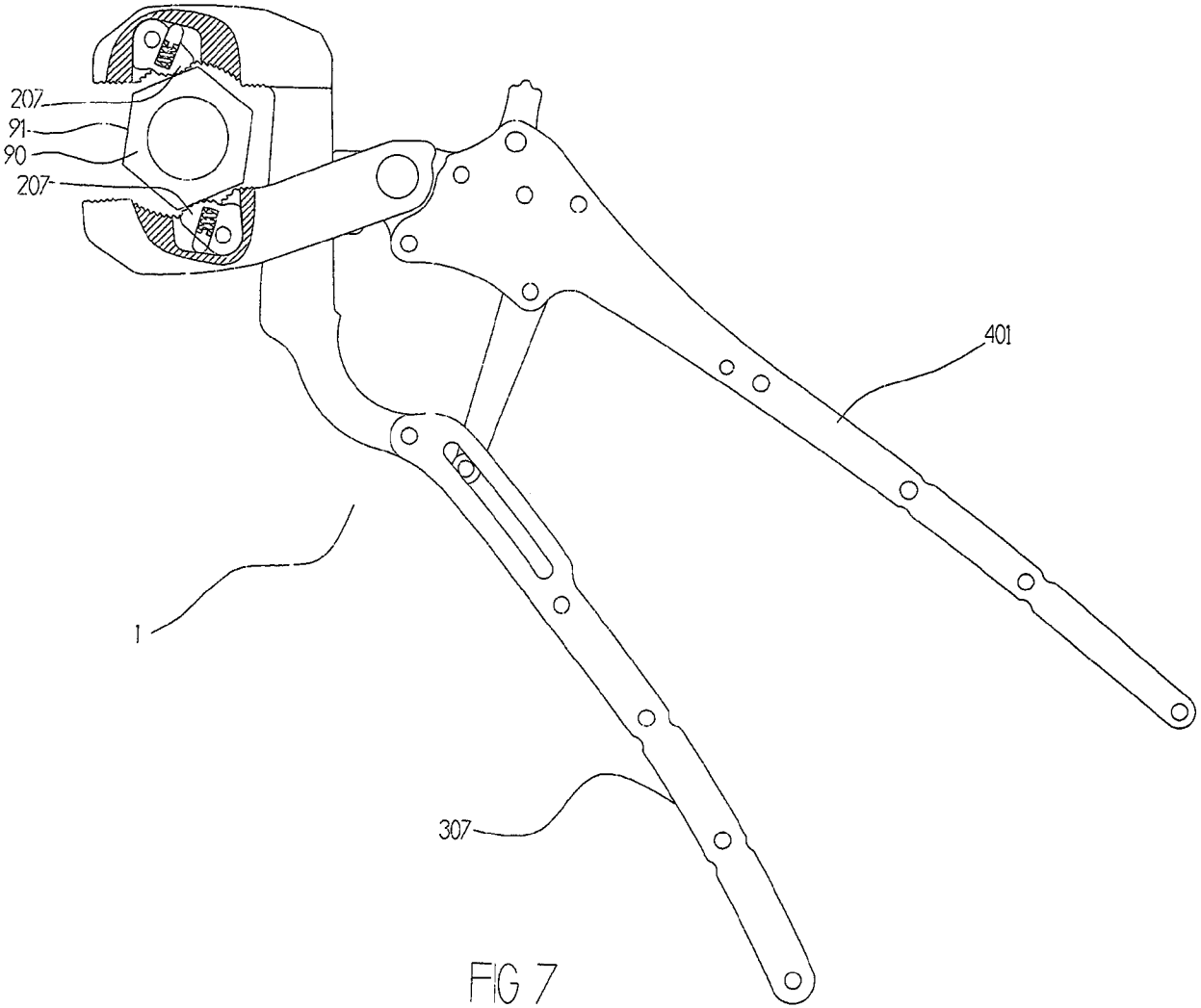
FIG. 7 is a side perspective of the pliers showing a cutaway of the jaws.
Figure 8:
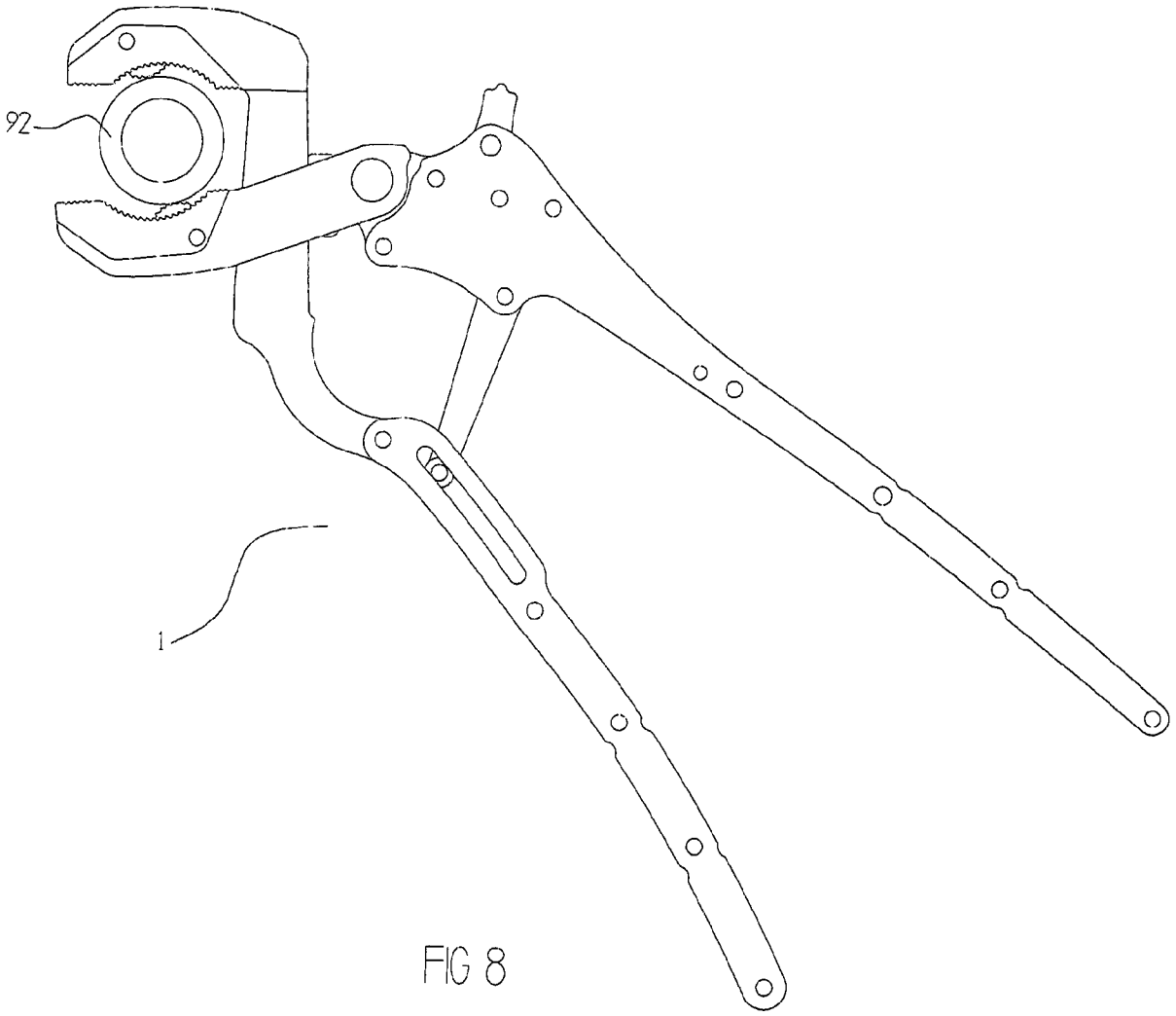
FIG. 8 is a side perspective view of the pliers gripping a pipe.

FIG. 7 shows the tool 1 being actuated in the reverse direction R whereby the cams 207 are suitably withdrawn W into their cavities 212 by the workpiece 90's extremities revolving against the cams 207 against the tension of their springs 210.

Figure 9:
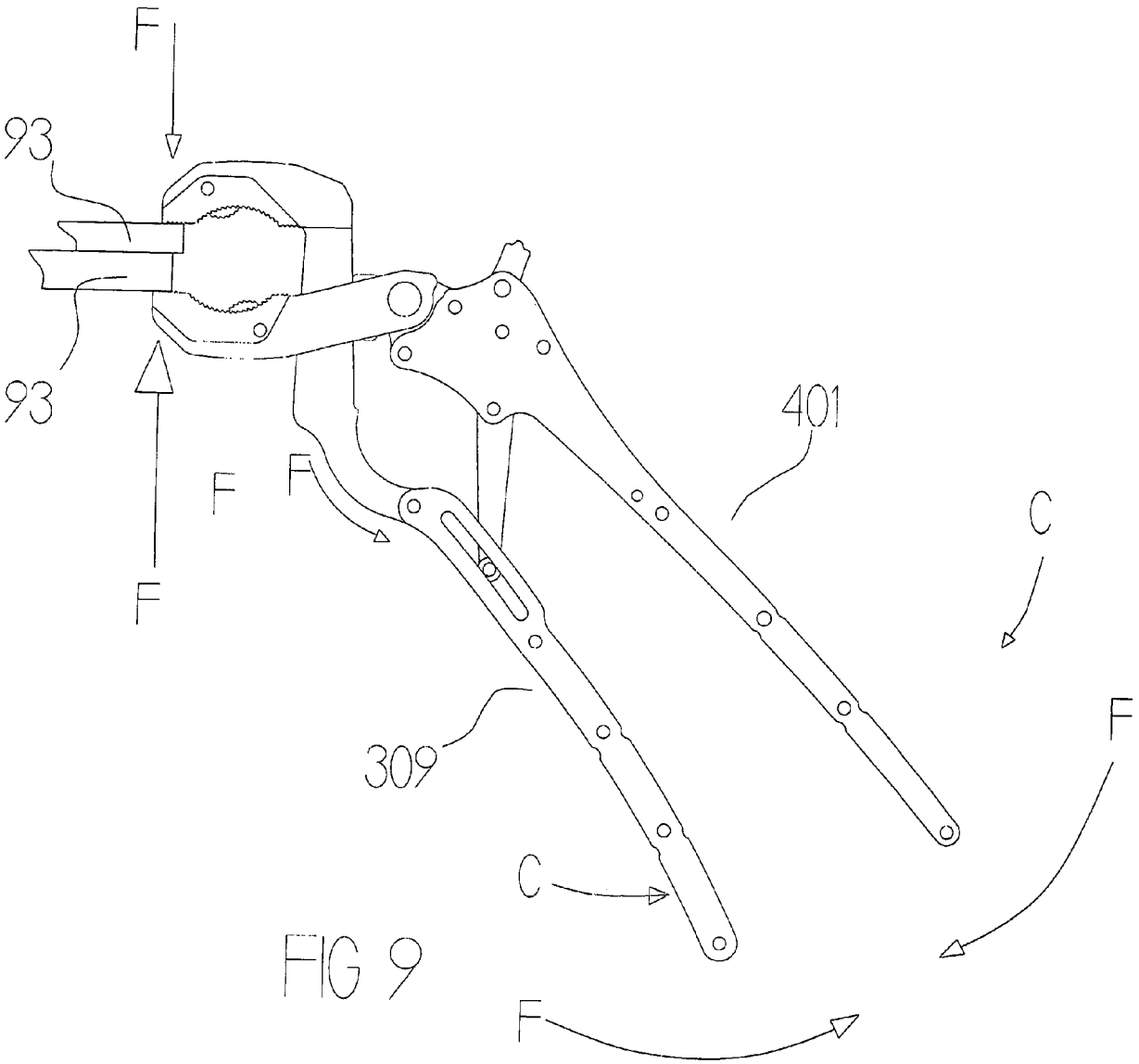
FIG. 9 is a side perspective view of the pliers utilized as a clamping device.
Figure 10:
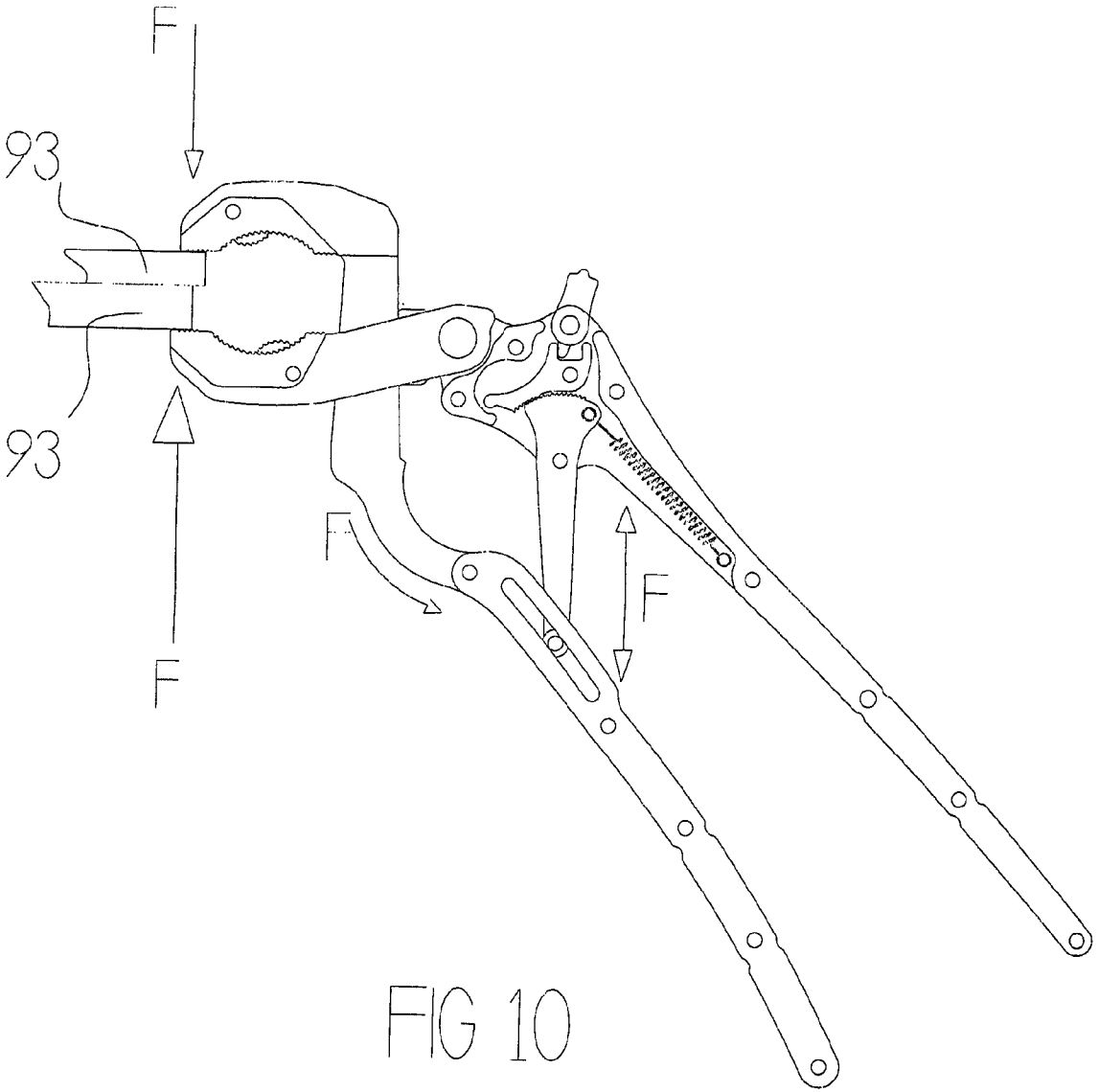
FIG. 10 is a side perspective view of the pliers utilized as a clamping device with a cutaway view of the handle.

FIGS. 9 &10 illustrate the sprung clamp pliers 1 wherein the tool 1 can be further usefully utilised as a clamping device. There are a myriad of reasons for using such a device from clamping and gripping in order to turn a fastener 90, especially a worn or damaged one to clamping two pieces of metal 93 together prior to welding them. The common failing in the prior art devices is if the clamped object or objects were to reduce their clamp width even slightly for whatever reason the solid grip imparted by these prior art devices would result in the failure of the devices ability to sustain further grip upon the objects.

In order to overcome these failings, the present device 1 deliberately incorporates an extremely strong method of resiliently closing or further resiliently locking closed the tools 1 grip via its jaws 201,202 of the worked objects.

In one example, the resilient portion 310 is incorporated into the fixed handle 300 between the gripping portion 309 and the clamp bar 301, the resilient portion 310 could also or further be incorporated into the pivotal link 70 or moving handle 400. The profile, material and thickness of the clamp resilient portion 310 is carefully chosen in order to provide a repeatable resilience with the least chance of stress cracking during repeated use. The profile is preferably a slow curve or arc 310 in the direction of the closing handle 300,400 force.

As further illustrated in FIG. 4 in order to provide a method of adjusting the clamping pressure exerted by the jaws 201, 202 the pivotal link 70 is rotatable around its axle pin 506 when the handles 300, 400 are clenched closing the jaws 201, 202 upon the workpiece 90 etc. As the handles 300, 400 are further activated the moving handle 400 pivots around its pivot pin 60 and the roller pin 62 fitted on the strut 70 extremity rolls down fixed handle 300 roller surface 304 guided within the channel or sliding slot 311. The pivotal link teeth 71 "ratchet" over the corresponding teeth 508 on the sprung 503 swivel lock 505 according to the closing pressure C applied. When the operator has reached the level of clamping C required and releases the applied grip C from the handle grips 309, 401 the ratchet teeth 71, 508 engage in a locking manner. The flex induced within the living spring portion 310 and clamping the jaws 201, 202 upon the clamped parts 93 is retained by the angle of the link 70 and the roller pins 62 engagement within the sliding slot 311. The arc 310, link 70, inner portion of the moving handle 400 and the moving jaw elongate portion 204 form a somewhat rhombus like frame wherein the tension can be retained for the purposes of placing the jaws 201, 202 under useful resilient gripping tension. If the clamped parts 93 were subjected to movement or vibration which would defeat the fixed clamping effect of prior art devices the present device 1 would still retain its grip albeit a lesser one.

Figure 11:
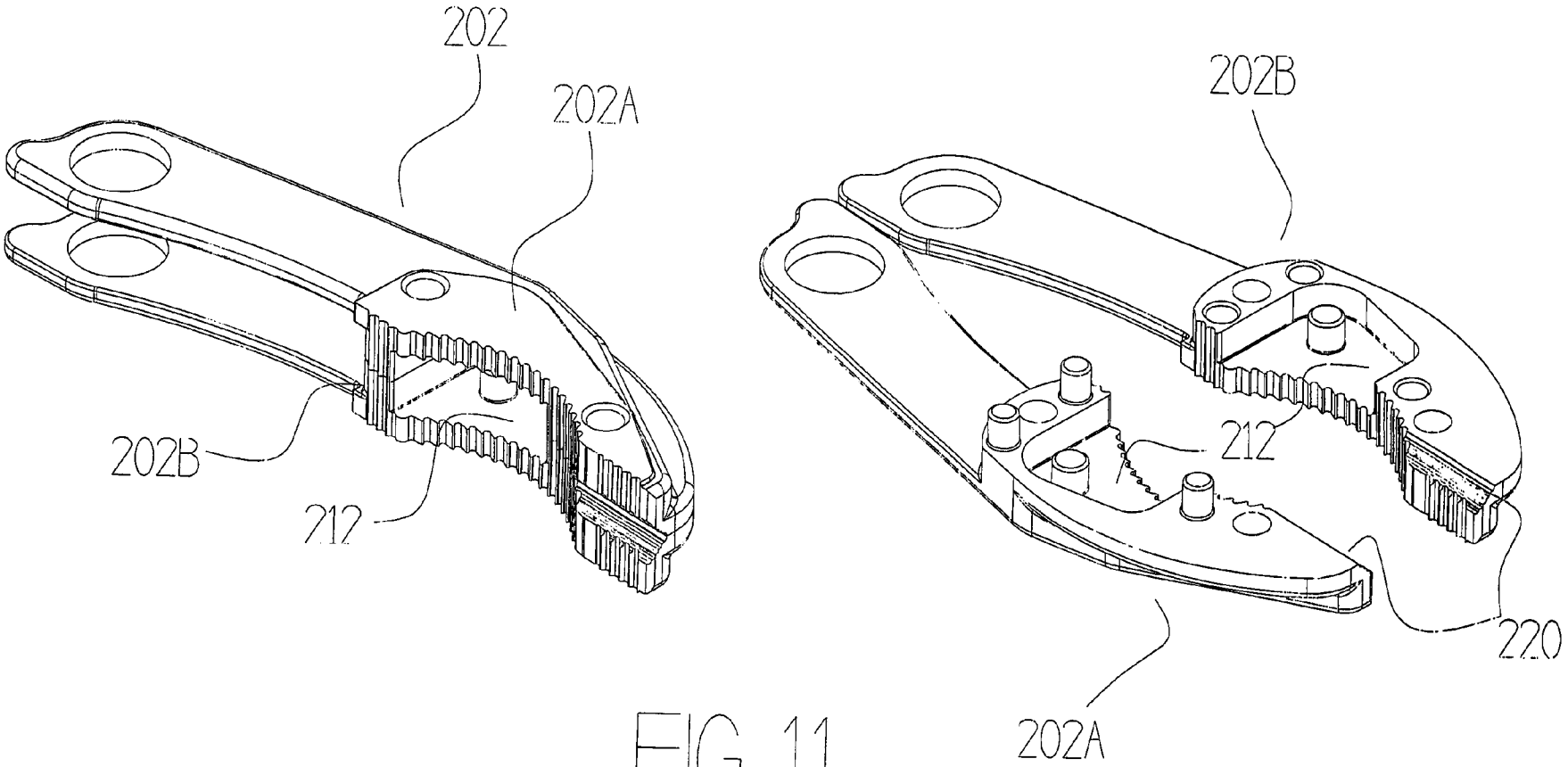
FIG. 11 is a perspective view of the jaw elements.
Figure 12:
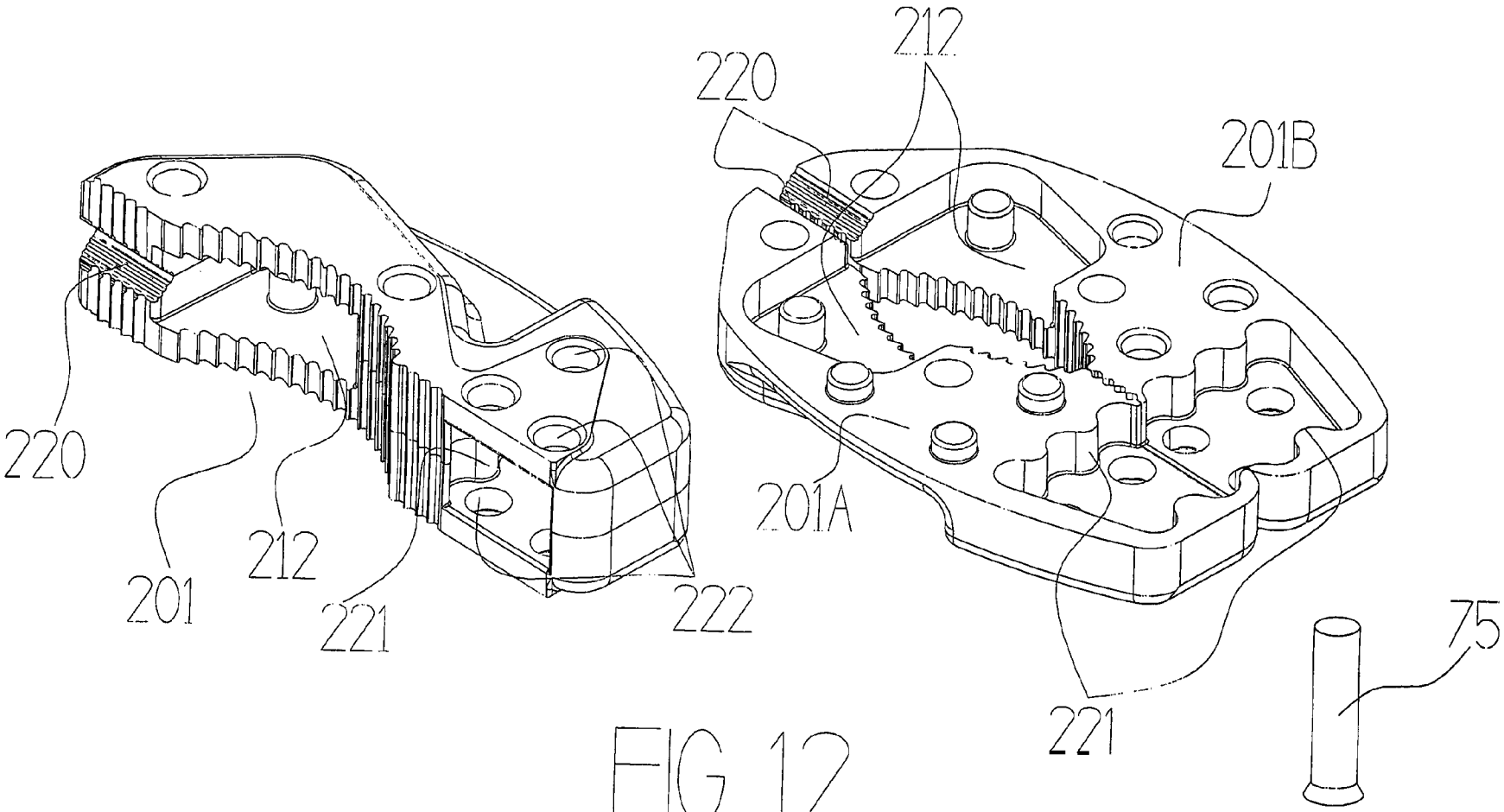
FIG. 12 is another perspective view of the jaw elements.

FIGS. 11 & 12 illustrates the jaws 201, 202 wherein the jaws 201, 202 are split lengthwise in order that they can be metal moulded preferably by the High Pressure Moulding method a novel method of 2D or open and shut injection moulding of a metal particle and plasticiser mix at extremely high pressure, with if required further treatment in a vacuum oven. This method is approximately around 30% less expensive than existing metal moulding (MIM) methods.

Splitting the jaws 201, 202 into at least two parts 201*a*, 201*b*, 202*a*, 202*b* allows the inner cavities 212 to be easier formed and far more complex than otherwise could be manufacturable.

Figure 13:
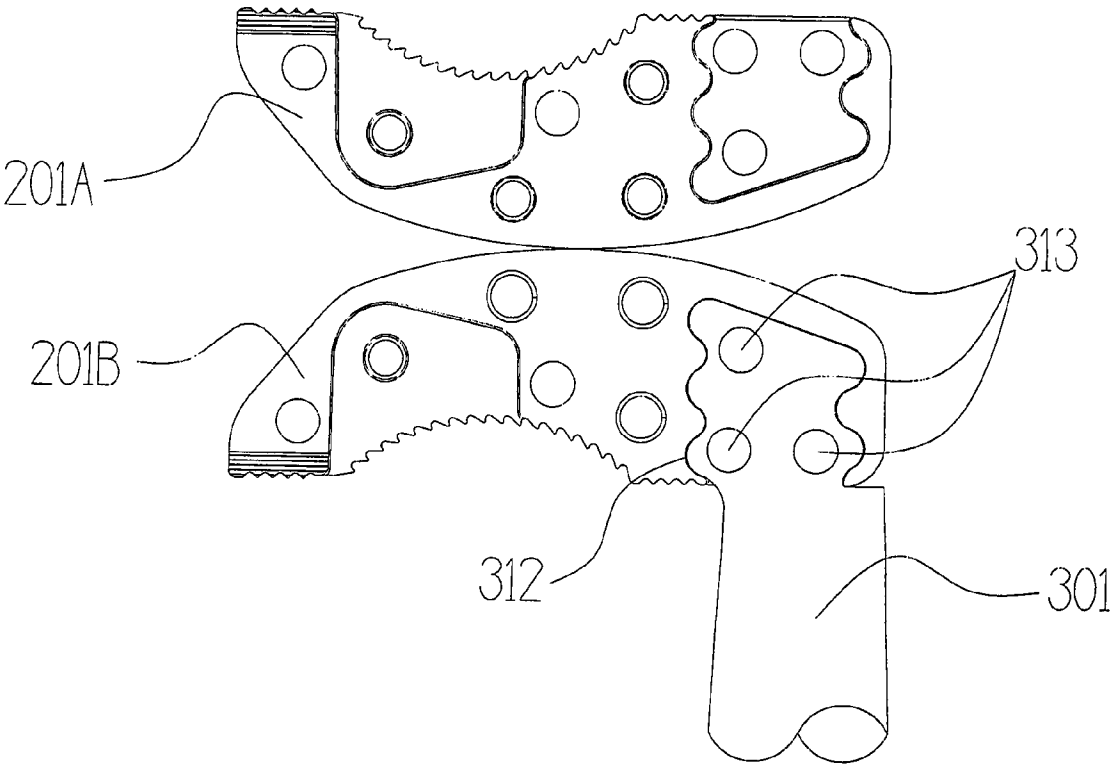
FIG. 13 is side view of corresponding fixed jaw elements.

As shown in FIG. 13 the fixed jaw 201 attachment to the fixed handle 300 can further be made by corresponding fixed jaw attachment profiles 221 and handle profiles 312. Further riveted jaw pins 75 can be utilised within their attachment pin holes 313 to help mechanically secure the jaws 201, 202 as required.

Numerous modifications and variations of the present invention are possible in light of the above teachings. It is therefore to be understood that within the scope of the attendant claims attached hereto, this invention may be practiced otherwise than as specifically disclosed herein.

What is claimed is:

1. A pliers apparatus comprising:

a first arm having opposing ends, a first end of said first arm forming a first handle, a second end of said first arm comprising a jaw element, said first arm comprising a channel;

a second arm having opposing ends, a first end of said second arm forming a second handle, said first arm is connected to said second arm thereby forming said pliers apparatus;

a second jaw element pivotally attached to a portion of a second arm, said second arm comprising at least one switch and at least one pawl; and at least one strut having opposing ends, a first end being pivotally attached to a portion of said second arm, a second end of said strut comprises a cam, said cam is designed to be fit within said channel of said first arm of said apparatus, said strut further comprising a resilient portion situated between said first and said second end of said strut, said resilient portion forms an arc, said arc curves away from said first jaw element, said switch is designed to be activated to thereby engage said pawl with said strut so that it functions as a ratcheting device and locks said first and second jaws, said switch is designed to be deactivated to thereby allow said pawl to disengage with said strut so that said apparatus functions as pliers.

2. The apparatus of claim 1 wherein said first jaw element has a first contact surface.

3. The apparatus of claim 2 wherein at least a portion of said first said contact surface Comprise a plurality of teeth.

4. The apparatus of claim 1 wherein said arc forms a radius from about 40 degrees to about 140 degrees.

5. The apparatus of claim 1 wherein said first jaw element is generally perpendicular to said first arm.

6. The apparatus of claim 1 wherein said arc has a width from about 5% to about 80% thinner than the rest of said second end of said first arm.

7. The apparatus of claim 1 wherein said second jaw element has a second contact surface.

8. the apparatus of claim 7 wherein at least a portion of said contact surface comprise a plurality of teeth.

9. The apparatus of claim 1 wherein said first and second jaw elements are moved by squeezing said first and second handles.

10. The apparatus of claim 1 wherein said switch has at least one spring.

11. The apparatus of claim 1 wherein said second arm has at least one spring.

12. The apparatus of claim 1 wherein said jaw element is a fixed jaw.

13. The apparatus of claim 1 wherein said cam comprises at least one protrusion.

14. The apparatus of claim 1 wherein said cam travels within said channel when said jaw elements contact one another.

15. The apparatus of claim 1 wherein said strut has a plurality of teeth that interact with said pawl.

16. The apparatus of claim 1 further comprising at least one shoe designed to assist in having said jaw members close parallel to one another to provide a tight grip.

17. The apparatus of claim 1 wherein said cam functions as a pawl catch.

18. The apparatus of claim 1 wherein said cam is a roller.

19. The apparatus of claim 1 further comprising at least two sleeves designed to cover said handles.

20. The apparatus of claim 1 wherein said cam comprises a cavity for receiving a cam spring.

21. A pliers apparatus comprising:

a first arm having opposing ends, a first end of said first arm forming a first handle, a second end of said first arm comprising a jaw element, said first arm comprising a channel;

a second arm having opposing ends, a first end of said second arm forming a second handle, said first arm is connected to said second arm thereby forming said pliers apparatus;

a second jaw element having a first end and a second end, said first end of said second jaw element having a contact surface, said second end of said second jaw element is pivotally attached to a portion of said second arm, said second jaw element further comprising a resilient portion situated between said first and second end of said second jaw element, said resilient portion forms an arc, said arc curves away from said first jaw element, said second arm comprising at least one switch and at least one pawl; and at least one strut having opposing ends, a first end of said strut is pivotally attached to a portion of said second arm, a second end of said strut has a cam, said cam is designed to be fit within said channel of said first arm, said switch is designed to be activated to thereby engage said pawl with said strut so that it functions as a ratcheting device and locks said first and second jaws, said switch is designed to be deactivated to thereby allow said pawl to disengage with said strut so that said apparatus functions as pliers.

22. A pliers apparatus comprising:

a first arm having opposing ends, a first end of said first arm forming a first handle, a second end of said first arm comprising a jaw element, said first arm comprising a channel;

a second arm having opposing ends, a first end of said second arm forming a second handle, said first arm is connected to said second arm thereby forming said pliers apparatus;

a second jaw element having a first end and a second end, said first end of said second jaw element having a contact surface, said second end of said second jaw element is pivotally attached to a portion of said second arm, said second jaw element further comprising a resilient portion situated between said first and second end of said second jaw element, said resilient portion forms an arc, said arc curves away from said first jaw element, said second arm comprising at least one switch and at least one pawl; and at least one strut having opposing ends, a first end being pivotally attached to a portion of said second arm, a second end of said strut has a cam, said cam is designed to be fit within said channel of said first arm, said strut further comprising an arc situated between said first and said second end of said strut, said switch is designed to be activated to thereby engage said pawl with said strut so that it functions as a ratcheting device and locks said first and second jaws, said switch is designed to be deactivated to thereby allow said pawl to disengage with said strut so that said apparatus functions as pliers, wherein said first and second jaw elements are moved and contact one another by squeezing said first and second handles.

* * * * *